United States Patent [19]

Moores, Jr. et al.

[11] 4,023,552

[45] May 17, 1977

[54] METHOD OF DRESSING THE GRINDING WHEEL IN A SHARPENER FOR TWIST DRILLS

[75] Inventors: Robert Gordon Moores, Jr., Cockeysville; Richard Eugene Walton, II, Baltimore, both of Md.

[73] Assignee: The Black and Decker Manufacturing Company, Towson, Md.

[22] Filed: Sept. 12, 1975

[21] Appl. No.: 612,911

Related U.S. Application Data

[62] Division of Ser. No. 456,946, April 1, 1974, Pat. No. 3,930,342.

[52] U.S. Cl. ..... 125/11 NT; 51/325

[51] Int. Cl.[2] ..... B24B 1/00; B24B 53/04

[58] Field of Search ..... 51/95 WH, 219 R, 219 PC, 51/283, 325; 125/11 R, 11 CD, 11 NT

[56] References Cited

UNITED STATES PATENTS

| | | | |
|---|---|---|---|
| 1,508,939 | 9/1924 | Reeves | 125/11 NT |
| 2,415,121 | 2/1947 | Wiken | 125/11 NT |
| 2,536,823 | 1/1951 | Smith | 51/219 R X |
| 2,644,277 | 7/1953 | Chatten | 125/11 NT X |
| 3,132,450 | 5/1964 | Boddaert | 51/219 R |
| 3,178,857 | 4/1965 | Grob | 51/219 R X |
| 3,552,375 | 1/1971 | Carr | 125/11 CD |

*Primary Examiner*—James L. Jones, Jr.
*Assistant Examiner*—Nicholas P. Godici
*Attorney, Agent, or Firm*—Leonard Bloom; Edward D. Murphy; Walter Ottesen

[57] ABSTRACT

A sharpener having a clam-shell housing in which a motor is mounted for driving a grinding wheel disposed adjacent one end of the housing, a chuck which holds either twist drills or a diamond dresser, the chuck being indexable 180° about its axis, and structure for mounting the chuck relative to the grinding wheel so that either the twist drill can be moved in a prescribed manner across the grinding periphery of the grinding wheel, or so that the diamond dresser can be moved across the grinding wheel in order to dress the wheel to a form suitable for sharpening twist drills or the like, and also means for moving the twist drills or the like or diamond dresser towards the grinding wheel.

1 Claim, 27 Drawing Figures

METHOD OF DRESSING THE GRINDING WHEEL IN A SHARPENER FOR TWIST DRILLS

This is a division of U.S. Pat. No. 3,930,342 which issued on Jan. 6, 1976 upon application Ser. No. 456,946, filed Apr. 1, 1974.

FIELD OF THE INVENTION

The present invention relates generally to an apparatus for sharpening the leading ends of twist drills or the like, and more particularly to an apparatus for grinding the leading ends of twist drills or the like which is an inexpensive self-contained unit that is easy to operate and requires little skill to operate, the ground point angle and relief angle being built-in and requiring no adjustment as different diameter twist drills are ground within the range designed into the machine.

BACKGROUND OF THE INVENTION

The present invention relates to a self-contained apparatus designed to sharpen general purpose right hand twist drills approximately ⅛ inch to approximately ½inch in diameter to commercial tolerances. A large number of prior art twist drill grinding machines are known in the art. These machines grind the points on twist drills or the like to desired contours by various methods. The present apparatus relates to a type of machine which grinds a cylindrical profile on each side of the leading end of the twist drill to either side of the web. One prior art patent which discloses an apparatus for grinding a cylindrical profile is U.S. Pat. No. 1,674,224 to Rabut issued June 19, 1928. The Rabut patent discloses a belt-driven grinding wheel, a chuck which is operable to support twist drills or the like with the leading ends of the twist drill in contact with a surface of the grinding wheel, and means to support the chuck relative to the grinding wheel. The supporting means include a frame which is pivotally secured to the base which also supports the grinding wheel, a carrier which is pivotally secured to the frame, a shaft journaled for rotation within the carrier, and an arm which extends away at an angle from the shaft, the arm in turn being interconnected with the chuck. A gauge is also mounted adjacent one end of the arm and means are provided for elevating and depressing the chuck and the gauge to accommodate twist drills of different sizes. The chuck is mounted in such a manner that it can be rotated or indexed about its center line 180 degrees between two working positions.

While the apparatus shown in the Rabut patent will satisfactorily grind the leading end of twist drills, it has numerous disadvantages. During the operation of the grinding apparatus shown in Rabut, it will be occasionally necessary to dress the grinding wheel to level off the surface which contacts the leading end of the twist drill. However, Rabut does not disclose any structure whereby a dressing tool could be mounted in his apparatus for dressing the grinding wheel, and thus, it would be necessary to provide additional means for dressing the grinding wheel. While a dressing tool could be mounted on the base of the Rabut machine in a manner taught by the U.S. Pat. No. 3,651,602 issued Mar. 28, 1972 to Hillier, such a device unnecessarily complicates the structure shown in Rabut and furthermore is somewhat difficult to operate so that the surface of the wheel which contacts the leading end of the twist drill lies in a surface parallel to the axis of rotation of the shaft which supports the chuck. Alternatively, a dressing tool could be carried by the chuck support in the manner taught by the U.S. Pat. No. 3,132,450 issued May 12, 1969 to Boddgert. While this design eliminates some of the disadvantages of Hillier, it unnecessarily complicates the design of the chuck support.

A further disadvantage of the apparatus shown in the Rabut patent is that it is difficult to provide for generally uniform wear of the grinding wheel. Thus, in order to present the leading end of the twist drill to different portions of the grinding surface of the grinding wheel, it is necessary to adjust either the frame which carries the chuck or to longitudinally adjust the shaft about which the chuck is swung during the grinding of the twist drills.

Another disadvantage of the Rabut construction is that the shaft about which the chuck rotates must be shifted toward and away from the axis of the grinding wheel during the grinding of the leading end of a twist drill and must also be shifted as the diameter of the grinding wheel varies. In order to maintain the proper geometry on the leading end of the twist drill during the grinding operation, it is therefore necessary to very accurately machine the bearings within the pivoting frame and the pivotal carrier, and it is also necessary to very accurately position the pivoting carrier on the frame during the grinding operation.

An additional disadvantage of the Rabut construction is that it requires adjustment of the gauge and chuck for twist drills of different diameters. Also, the gauge of Rabut only initially positions the point of the twist drill and does not serve as a final gauge to properly locate the twist drill during the final grinding operation on the leading end. In this connection, it should be noted that it may sometimes be necessary to grind a large quantity away from the leading end of the twist drill, either because of severe wear on the leading end of the drill or because of a broken point. In this case, because the flutes are spirally disposed about the drill, the final position will not in any way correspond to the initially engaged position. While other gauges are well known in the prior art, as for example U.S. Pat. No. 2,614,370 issued Oct. 21, 1952 to Kopnick, devices of this type do not overcome the foregoing disadvantages.

A further disadvantage of the Rabut construction is that it is not a self-contained unit and therefore must be mounted in such a manner that it can be driven from a power take-off shaft within the shop through a belt or the like.

OBJECTS AND SUMMARY OF THE INVENTION

It is a general object of the present invention to provide a self-contained, inexpensive, easy to operate twist drill sharpener wherein adjustments are kept to a minimum and little skill is required to operate.

More specifically, it is an object of the present invention to provide a drill bit sharpener wherein means are provided to move the leading end of the drill bit across the surface of a grinding wheel to minimize wear upon the grinding wheel.

It is another object of the present invention to provide an apparatus for sharpening twist drills or the like wherein drills of various diameters within a given range may be sharpened to commercial tolerances without any adjustments other than the initial gauging of the twist drill or the like within the device which holds the twist drill.

It is another object of the present invention to provide an apparatus for sharpening twist drills or the like, wherein the means which hold the twist drills or the like may also hold a tool for dressing the grinding wheel wherein means are provided for properly orienting the dressing tool with respect to the grinding wheel, and wherein additional means are provided to move the dressing tool across the surface of the grinding wheel.

It is another object of the present invention to provide an apparatus for grinding twist drills or the like, wherein the means for holding the twist drills or the like are rotatably carried by a shaft, and wherein means are provided to pivot the shaft about an axis transverse to the axis of the shaft so that the drill bit holding means may be moved toward and away from the grinding wheel.

It is a further object of the present invention to provide a chuck which supports twist drills or the like and a gauge on the forward end of the chuck, the gauge being employed to properly position the drill bit within the chuck and also to gauge the distance between the chuck and the surface of a grinding wheel so that a proper contour is formed on the leading end of the twist drill or the like.

These and other objects and advantages of the present invention are accomplished by providing a clam-shell type housing, drive means mounted within the housing, a grinding wheel disposed adjacent one end of the housing, a pivot rod supported within the housing for rocking movement of one end of the pivot rod toward and away from the grinding wheel and for either spiral motion of the pivot rod when grinding twist drills or the like, or for solely longitudinal movement of the pivot rod when dressing grinding wheels, a chuck indexable 180° about its axis between first and second operative positions, means to support the chuck on one end of said pivot rod, said means being movable between an operative position wherein one end of the chuck is disposed adjacent the grinding wheel and a second position disposed away from the grinding wheel to provide for the loading of twist drills or the like within the chuck, and a gauge or locator mounted upon the leading end of the chuck, the gauge being engagable with a sidewall of the flute of the twist drills or the like to properly orient the twist drill within the chuck, the gauge also serving to finally position the chuck adjacent the grinding surface of the grinding wheel so that the wheel is accurately dressed and so that the final ground surface on the leading end of the twist drills or the like meets commercial tolerances. The foregoing structure will be described in greater detail with reference to the accompanying drawings in which a preferred form of this invention is illustrated.

BRIEF DESCRIPTION OF THE DRAWINGS

FIG. 8 is a side view of one end of the chuck showing the locator or gauge associated with the leading end of a twist drill or the like.

FIG. 11 illustrates the prior art manner of locating the leading ends of twist drills or the like.

FIGS. 17 and 18 are somewhat similar to FIGS. 3B and 16 but show the relative position of various components during the grinding of the leading end of the twist drill or the like.

DETAILED DESCRIPTION OF THE PREFERRED EMBODIMENT

In General

Figure 3A:
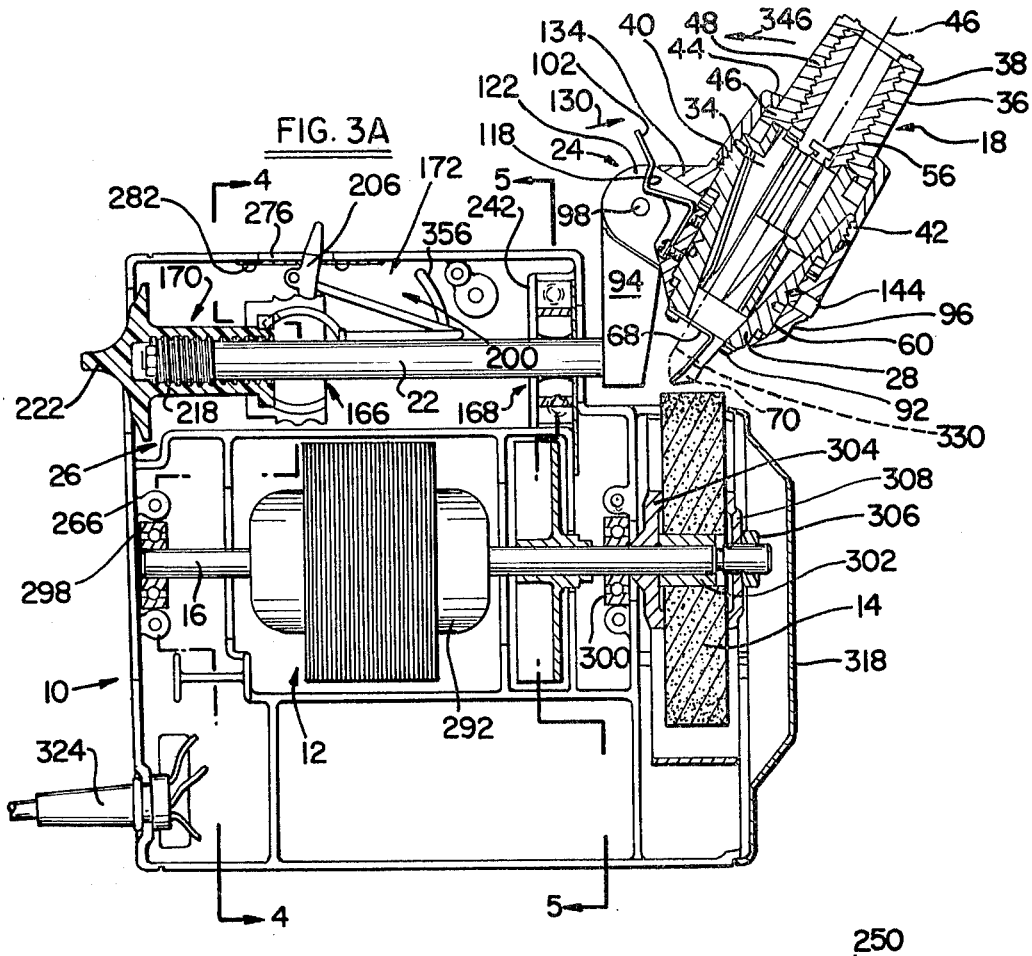
FIG. 3A is a section taken through the apparatus shown in FIG. 1, the chuck carrying a tool for dressing the grinding wheel.

With reference to the various figures, and particularly FIG. 3, the embodiment shown in the drawings includes a frame indicated generally at 10, the frame being in the form of a clam-shell housing, drive means disposed at least in part within the housing, the drive means being indicated generally at 12, a rotary abrasive member or grinding wheel 14 mounted upon the output shaft 16 of the drive means, the grinding wheel being disposed adjacent one end of the housing, means operable to hold twist drills or the like or tools for dressing the grinding wheel, the holding means being indicated generally at 18, and a locator or gauge mounted on one end of the holding means 18, the locator being indicated generally at 20. Interconnecting means are provided which are operable to interconnect the holding means with the frame, the interconnecting means including a shaft or pivot rod 22, mounting means operable to mount the holding means on one end of the pivot rod adjacent the grinding wheel, the mounting means being indicated generally at 24, and means to mount spaced apart portions of the pivot rod within the housing, the pivot rod mounting means being indicated generally at 26. The pivot rod mounting means 26 provides for various motions of the pivot rod. Thus, the pivot rod can be rotated about its axis, can be moved in a spiral fashion about its axis, can be shifted in a longitudinal linear motion along its axis, and it can also rotate about an axis generally transverse to the axis of the pivot rod. The manner in which the rod is mounted will be more fully brought out below, however, the purposes of the various motions will be briefly summarized at this point. Thus, when the leading end of twist drills or the like are being ground, the pivot rod and, therefore, the holding means which carries the pivot rod, will be caused to be moved in a spiral path about the axis of the pivot rod. In addition, the pivot rod will be rocked about an axis 27 (FIG. 4) normal to a plane which passes through the axis of the pivot rod and the axis of rotation of the grinding wheel to move the holding means closer to the grinding surface of the grinding wheel until the leading end of the twist drill or the like has been properly ground. By employing a spiral motion during the grinding of the leading end of the twist drills or the like, the grinding surface of the grinding wheel will be more uniformly worn away than if only a rotary motion about the axis of the pivot rod were employed. However, it will still be necessary on occasion to dress the grinding surface of the grinding wheel. When a dressing tool is carried by the holding means, the holding means is rotated to a stop position which places the dressing tool in the proper position for dressing the surface of the grinding wheel, and then the pivot rod is shifted along its axis while the holding means is still maintained in its proper attitude. The pivot rod is also pivoted about the transverse axis 27 to move the dressing tool toward the axis of rotation of the grinding wheel to dress additional amounts of material off the grinding surface of the wheel until a proper surface is dressed on the grinding wheel.

Holding Means

Figure 6:
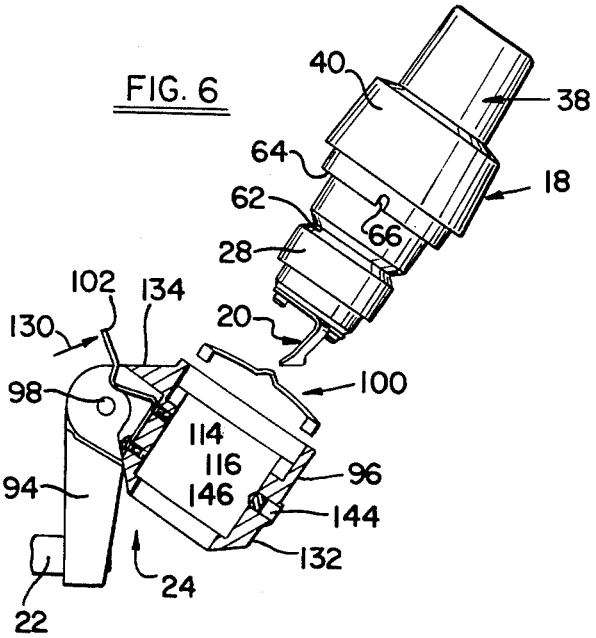
FIG. 6 is an exploded view of the chuck and its mounting structure, the mounting structure being shown in its operative position.

The holding means indicated at 18 is operable to hold either twist drills or the like with the leading end of the twist drill or the like in contact with a surface of the grinding wheel, or to hold a dressing tool with the leading end of the dressing tool being disposed in contact with the grinding surface of the grinding wheel. The holding means shown in this embodiment is a chuck which is adapted to receive twist drills or the like of various diameters concentrically within the chuck, the preferred range of diameters running from approximately ⅛ inch to approximately ½ inch. The chuck includes a nose piece 28 having a frusto-conical inner surface 30, a spacer 32 mounted within the nose piece 28, a plurality of jaws 34 having an outer surface adapted to engage the frusto-conical surface 30, a pusher member 36 which is interconnected with the plurality of jaws 34, a nut 38 which is adapted to impart linear movement to the pusher member 36 upon rotation of the nut and a sleeve member 40. The sleeve member 40 is provided with an internal thread which engages a corresponding thread on the nose piece 38, the threads being indicated at 42. Thus, the sleeve member can be unscrewed from the nose piece for disassembly of the various components of the chuck. When in the assembled position shown in FIG. 3B, the flange 44 of the sleeve member engages a cooperating flange 46 on the nut 38 to hold the parts in their assembled relationship. The nut 38 can rotate relative to the sleeve 40, the nose piece 28 and the pusher member 36 and rotation of the nut will cause the pusher member 36 to be moved linearly along the axis 46 of the chuck due to the interaction of the threads 48 carried by the inner cylindrical surface of the nut 38 and the outer cylindrical surface of the pusher member 36. The spacer 32 is provided with an outwardly extending flange 50 at one end, the flange 50 being clamped between an end 52 of the nose piece 28 and a shoulder 54 on the inner cylindrical surface of the sleeve member 40. In the embodiment shown three jaws are employed, and these jaws are mounted for sliding motion within three radically spaced apart grooves on the spacer 32. As the pusher member 36 engages the rear end of the jaws 34 by means of key-hole slot 56, the pusher member is not free to rotate about the axis 46 of the chuck. Thus, when the nut is rotated the pusher member will be screwed in one direction or the other which will in turn advance or retract the jaws 34 within the nose piece 28 to either open or close the chuck. The jaws 34 are provided with relatively long engaging surfaces 58 so that the engaging surfaces are long enough to completely define the diameter of the bit or twist drill, at least two of the surfaces contacting the margin of the twist drill in two places, the third surface contacting the margin of the twist drill in at least one place. This must be true of the largest bit with the longest spiral to be held. If this were not true, the bit would rock and would not be stable within the chuck. The nose piece 28 is provided with an outer cylindrical surface 60 which is concentric with the frustro-conical surface 30 and the axis 46 of the chuck. A V-shaped groove 62 is formed in the surface 60, the groove extending all the way around the surface of the nose piece. The nose piece is also provided with a radially outwardly extending shoulder 64 adjacent one side of the surface 60, the shoulder 64 being provided with two semi-cylindrical recesses 66 as can best be seen in FIG. 6, the semi-cylindrical recesses being spaced apart from each other exactly 180°. The V-shaped groove 62 and semi-cylindrical recesses 66 are utilized in the mounting of the chuck within the mounting means 24 for indexing the chuck 180 degrees between two operable positions, and the manner in which they cooperate with the mounting means will be more fully brought out below.

Locator

Figure 11:
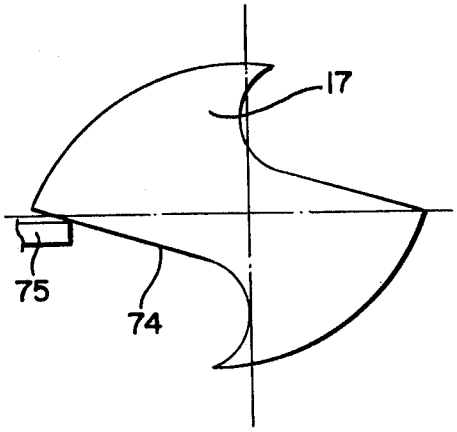
FIG. 11 PRIOR ART
Figure 14:
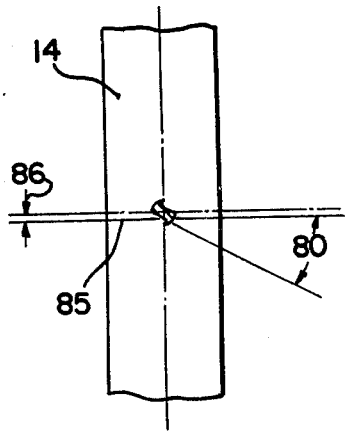
FIGS. 14 and 15 are views somewhat similar to FIGS. 12 and 13 but showing the twist drill or the like located with respect to the grinding wheel, FIG. 14 showing relatively small diameter twist drill, and FIG. 15 showing a larger diameter twist drill.
Figure 15:
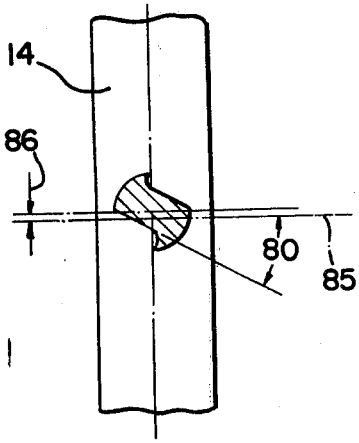

The locator 20 for twist drills or the like is mounted on one end of the chuck. The locator includes a circular mounting portion 68, and a tapered leading end 70 which extends toward the grinding wheel, the tapered leading end having an edge 72 engagable with the side wall 74 of one of the flutes 76 of the twist drill or the like. The edge 72 will engage the sidewall 74 adjacent the cutting lip 78 (FIG. 17), the edge being adapted to be disposed a predetermined distance away from the surface of the grining wheel means when the twist drill or the like has been properly ground. Means are provided for resiliently supporting the leading end of the locator in such a manner that the edge will always be disposed at a predetermined angle with respect to the center line or axis of the grinding wheel when the chuck is in one of its two operable positions. This relationship is best illustrated in FIGS. 14 and 15, FIG. 14 showing how a one-eighth inch diameter drill is positioned by the locator, the drill being shown in section where the locator engages the sidewall of the flute, and FIG. 15 showing the positioning of a ½ inch diameter drill. Stated another way, the leading edge of the locator is supported in such a manner that when the edge of the leading end contacts the side of one of the flutes of a twist drill, it establishes a line which is parallel to the other lines established when the locator contacts twist drills of different diameters and web thicknesses. Thus, with reference to FIGS, 12 and 13, which illustrate the locator contacting sidewalls of twist drills of different web diameter, it can be seen that the line 82 would be parallel to the line 84. The angle 80 is so selected that when the twist drill is ground, a proper relief angle is formed on the margin of the twist drill adjacent the cutting lip. There is a cooperative effect between the angle 80 and the offset or eccentricity of the axis of the twist drill. Thus, the axis 46 of the chuck is offset from the axis 85 of the pivot rod, and, by properly selecting the offset distance 86 (FIGS. 14 and 15), the grinding radius and the angle 80, the lip relief angle will be ground to commercial tolerances for the range of drills adapted to be held by the chuck. Thus, in the embodiment illustrated, the lip relief angle of approximately 18°–20° will be ground in ⅛ inch drills, while a lip relief angle of approximately 8°–10° will be ground in ½ inch twist drills or the like. However, it is essential that the angle 80 be maintained. If a gauging device 75 of the prior art were employed, this being illustrated in FIG. 11, only one edge of the sidewall of the flute would be contacted and if the drill were of relatively great web thickness, as shown in FIG. 11, then it would not be possible to obtain the proper lip relief angle.

Figure 10:
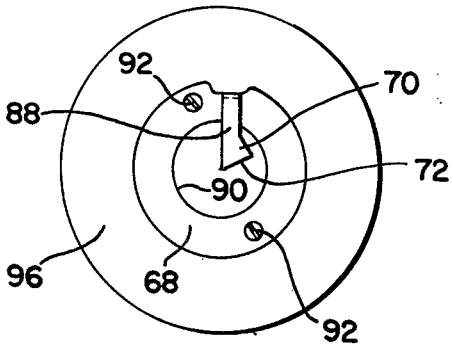
FIG. 10 is a bottom view of the structure shown in FIGS. 8 and 9.

The means for supporting the tapered leading end is a strip of flexible material 88 or it may be a stiff element on a flexible support. In this connection, it should be noted that the locator is preferably formed to its desired final shape from a single piece of sheet material. The circular mounting portion 68 is provided with a central aperture 90 (FIG. 10), and is mounted on one end of the nose piece 28 of the chuck by cap screws 92.

Means for Mounting the Chuck on One End of the Pivot Rod

Figure 3B:
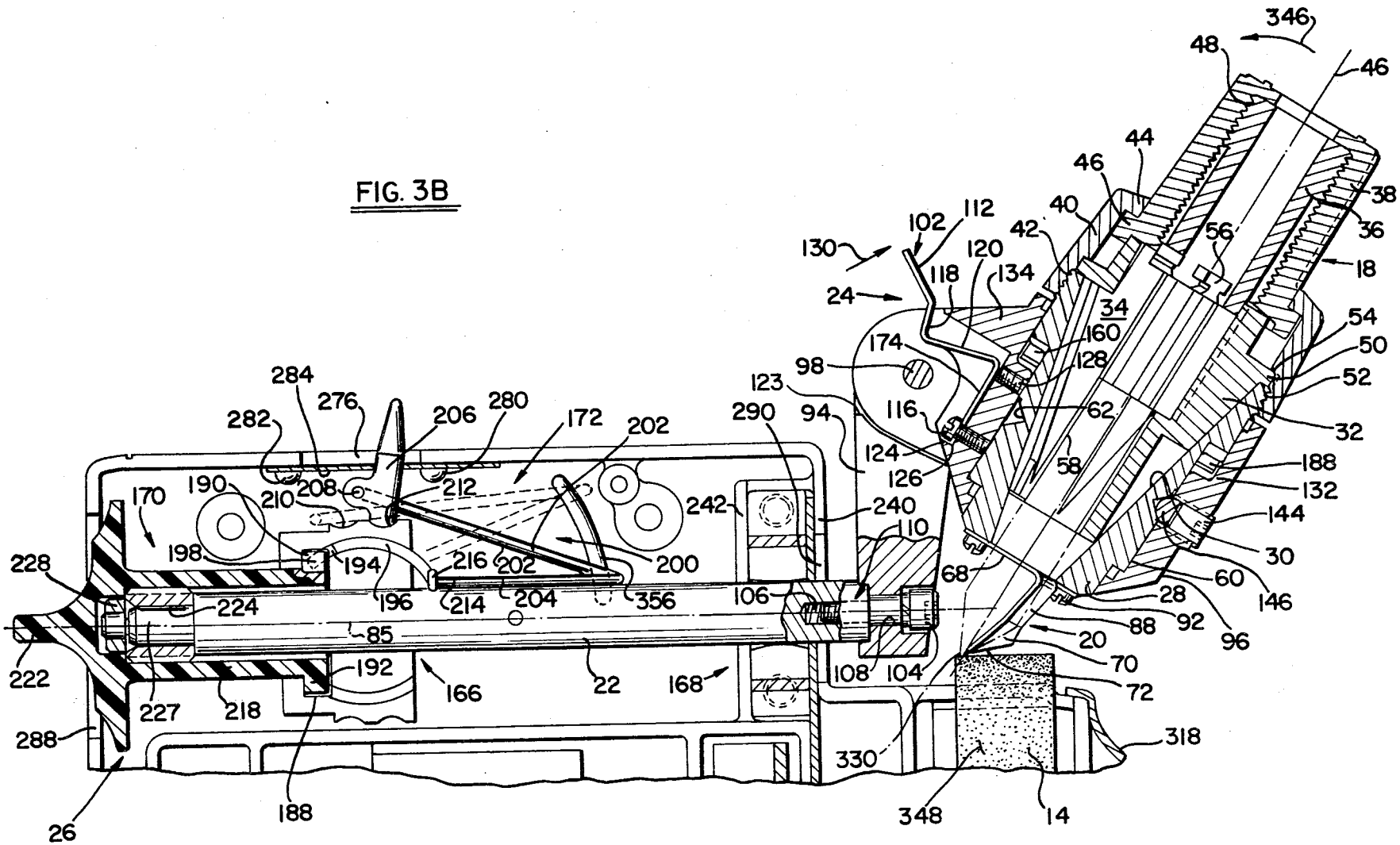
FIG. 3B is an enlargement of a portion of FIG. 3A.
Figure 7:
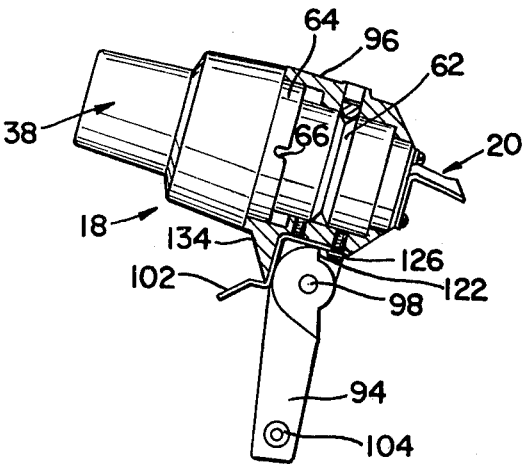
FIG. 7 illustrates the chuck mounting structure in its inoperative position.
Figure 8:
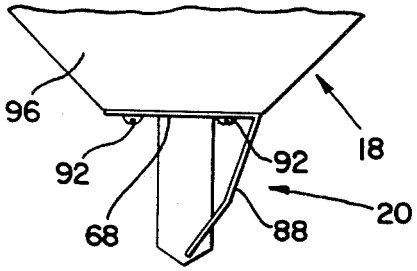
Figure 9:
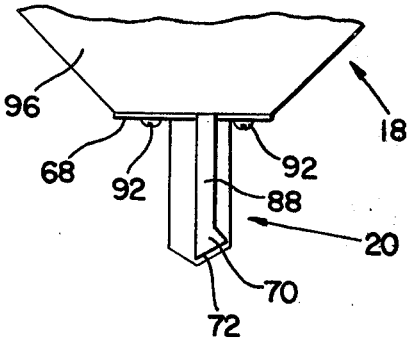
FIG. 9 is a front view of the structure shown in FIG. 8.

The means 24 for mounting the chuck on one end of the pivot rod provides for indexing of the chuck 180° about its axis 46 between two operable positions, and also for the swinging of the tool holder or chuck between operative and inoperative positions, the inoperative position being shown in FIG. 7 and the operative position being shown in other Figures which illustrate the chuck mounting means. The chuck mounting means include a pivot arm 94 which is non-rotatably secured to one end of the pivot rod 22 and a swing head 96 which is pivotally secured by pivot pin 98 to the pivot arm 94, a detent spring, indicated generally at 100, the spring cooperating with the swing head and the nose piece of the chuck to provide for the indexing of the chuck 180° about its axis, and a jam or lock spring 102, the jam spring cooperating with the pivot arm 94 and the swing head 96 to lock the swing head and the chuck in their operative position, but also providing for movement of the swing head and chuck to the inoperative position. The inoperative position is utilized for loading twist drills or the like into the chuck. With reference to FIG. 3B, the pivot arm is rigidly secured to one end of the pivot rod 22 by fastener means 104, the fastener means engaging a threaded aperture 106 in the end of the pivot rod. The end of the pivot arm 94, adjacent the end of the shaft 22 to which it is secured, is provided with an aperture 108 which receives the fastener means 104, a portion of the aperture being shaped to slidably and non-rotatably engage a D-shaped end section 110 of the pivot rod.

The jam or lock spring 102 is formed from sheet spring steel into a generally Z-shape, one of the end legs being provided with a bent-out portion 112 which is adapted to be engaged by the operator. The other leg 114 is secured to the swing head by a fastener 116. A stop or lock portion 118 is disposed at approximately a right angle to the intermediate portion 120, the stop or lock portion engaging a first shoulder 122 (FIG. 7) on the pivot arm 94. When the swing head and chuck are in their operative or working position, shown in FIG. 3B for example, a second shoulder 124 is engaged by a portion 126 on the swing head which is disposed to the opposite side of the pivot 98 from the stop portion 118 of the jam spring 102. When both shoulders 122 and 124 are engaged by the jam spring 102 and the engaging portion 126, the swing head and chuck are firmly held in their operative position. It should be appreciated that in the manufacture of the jam spring 102, pivot arm 94, and swing head 96 that slight variations will occur and, therefore, an adjusting screw 128 is provided to move the stop portion toward and away from the shoulder 122. The shoulder 122, which is contacted by the stop portion 118, forms an angle with the intermediate portion 120 that is greater than the angle formed by the intermediate portion 120 and the stop portion 118. Therefore, as the spring 102 moves into its stop position a jamming action between the spring and the shoulder is achieved to further ensure precise positioning of the swing head and chuck when they are being held in their operative position. To move the swing head and chuck to the inoperative position, it is only necessary to bias the bent-out portion 112 in the direction indicated by the arrow 130 until the end of the stop portion 118 nearest the pivot 98 clears the shoulder 112, at which point the holding means may be swung to its inoperative or loading position.

Figure 21:
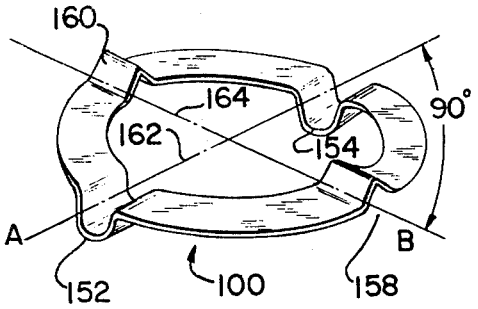
FIG. 21 is a perspective view of a detent spring which is associated with a chuck and its mounting structure for indexing the chuck 180°.
Figure 22:
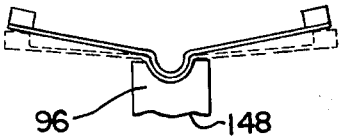
FIG. 22 is a side view of the detent spring shown in FIG. 21 and a portion of the chuck mounting structure, the full lines indicating the detent spring in its free position, and the broken lines indicating the detent spring in its assembled position.
Figure 23:
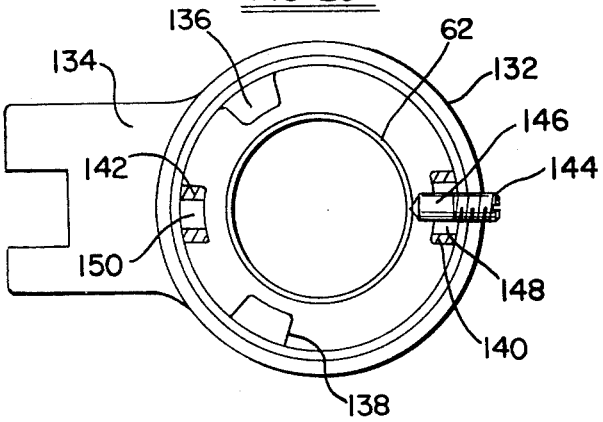
FIG. 23 is a plan view of a portion of the chuck mounting structure.

The swing head consists essentially of a generally cylindrical portion 132, and a mounting or ear portion 134 which is formed integrally with the cylindrical portion 132. The ear portion is suitably apertured to receive the pivot pin 98 which secures the swing head to the pivot arm 94. A suitable cavity is formed in the ear portion of the reception of the jam spring 102. As can best be seen from FIG. 23, the inner surface of the cylindrical portion 132 of the swing head 96 is provided with four ribs 136, 138, 140, and 142. Ribs 136, 138 and 140 are radially spaced apart from each other 120° and act as centering ribs for the chuck. In addition, a cone point set screw 144 and a nylon plug 146 are mounted within a threaded aperture which extends from the surface through the center of the rib 140, the plug 146 being forced into engagement with the V-shaped groove 62 in the nose piece 28 of the chuck to assemble the parts. Thus, when the plug snugly engages the V-shaped groove 62, the chuck acts against the two ribs 136, 138 which acts as V-blocks giving the best possible positioning of the chuck, and the chuck is held from relative movement with respect to the swing head with the exception of rotary movement about its axis. Each of the ribs 140, 142, which are spaced away from each other by 180°, is provided with a semi-cylindrical recess 148, 150, respectively, which receives the semi-cylindrical U-shaped portions 152, 154 of the detent spring 100. The detent spring 100 is also provided with two V-shaped portions 158, 160, these portions being adapted to engage the recesses 66 in the nose piece 28 of the chuck. The detent spring 100 is circular, and the portions 152, 158, 154, 160 are spaced apart in 90° increments from the center of the spring. The true angular position of the chuck is governed by the accurate positioning of the recesses 148 and 150 in the swing head 96, by the accurate positioning of the recesses 66 in the nose piece, and also by the accurate positioning of the portion 152, 154, 158, 160 in the detent spring 100. Once these positions have been accurately established, indexing of the chuck 180° is very accurately determined because the spring can move along the axis 162 (FIG. 21) relative to the swing head 96 and the axis 164 relative to the chuck to take up for any eccentricity of the portions 66, 148, 150, 152, 154, 158 and 160. The U-shaped configuration of the portions 152, 154 is such that they keep the springs stationary with respect to the holder and also expand into their seats as the circular spring is moved from its free position shown in full lines in FIG. 22 to their assembled position shown in dotted lines in FIG. 22. The configuration of the V-shaped portions 158, 160 is such that when the chuck is turned, it overrides these portions. However, when they seat, the chuck is firmly held in one of two operative positions.

Means for Mounting the Pivot Rod

Means are provided for mounting or journaling a first portion of the pivot rod within the housing 10 for various motions, the principle components of the pivot rod mounting means being first bearing block means indicated generally at 166 (FIG. 3), and second bearing block means indicated generally at 168, the first and second bearing blocks being in turn mounted on the housing for rocking motion of the first bearing block means and vertical sliding motion on the second bearing block means. Associated with the first bearing block mens 166 is a rotatable member, indicated generally at 170, the rotatable member having a sleeve portion, the rotatable member being mounted in such a manner that it may be rotated relative to the first bearing block means 166, there also being locking or engaging means, indicated generally at 172, the locking or engaging means being movable between two positions and being operable to hold the rotatable sleeve member 170 from rotation when it is in its first position and permitting rotation of the rotatable member 170 when the locking means is in its second position. Associated with the second bearing block means 168 are means 174 (FIG. 5) to move the second bearing block means toward and away from the axis of the grinding wheel 14.

Figure 4:
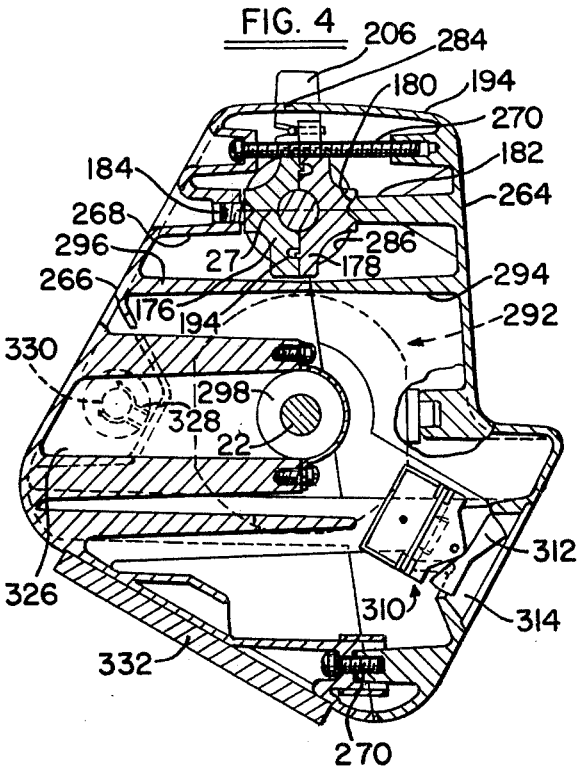
FIG. 4 is a section taken along the lines 4—4 in FIG. 3A.
Figure 16:
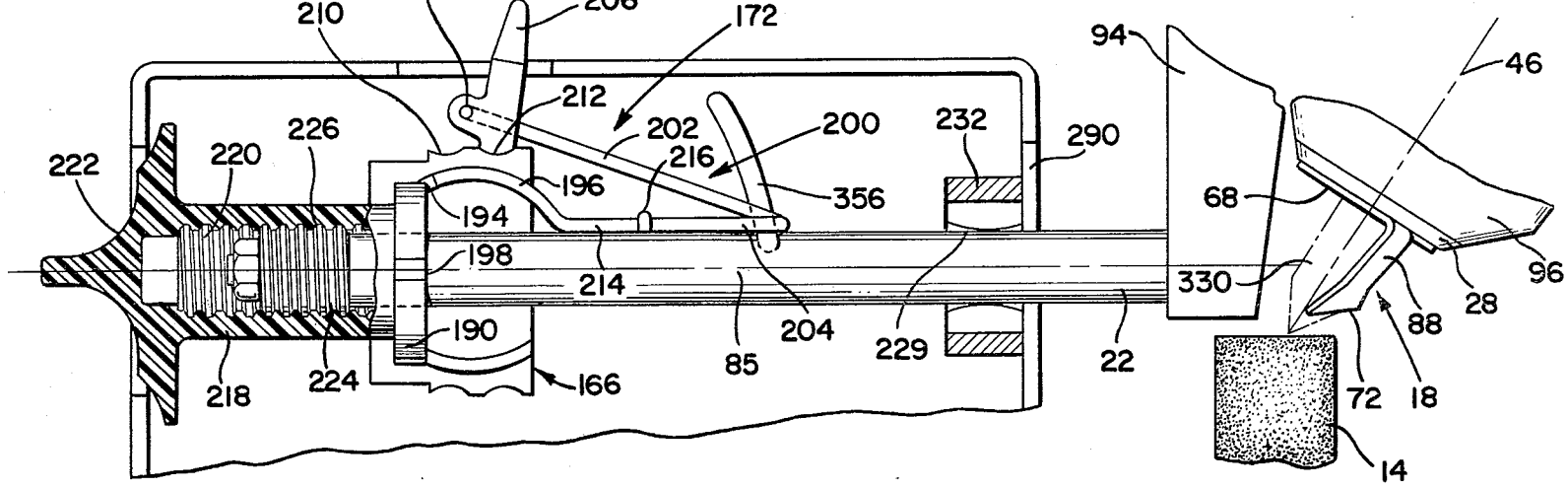
FIG. 16 is a view somewhat similar to FIG. 3B, this view illustrating a dressing tool engaging one side of the grinding surface of a grinding wheel.

The first bearing block means 166 is formed from two bearing halves 176, 178 (FIG. 4). Each of the two bearing halves are identical to each other to simplify manufacture. The bearing halves are mounted about the pivot rod 22 and are provided with trunion receiving portions 180 which are engaged by spaced apart trunions 182, 184 on the housing 10. The trunion 182 is fixed to one of the two portions which forms the clamshell housing, and the other trunion 184 is carried by the other of the two housing portions and is adjustable toward and away from the first trunion in order to provide for good mounting of the bearing block. The two bearing halves 176, 178 form a cylindrical aperture when assembled which slidably and rotatably receives the pivot rod 22, the inner cylindrical surface of the aperture being indicated at 186. The bearing halves also form an enlarged cylindrical recess 188 adapted to rotatably receive a flange portion 190 of the rotatable member 170 in such a manner that the rotatable sleeve member can be rotated relative to the bearing block but cannot shift in an axial manner along the axis 85 of the pivot rod. Each of the bearing halves 176, 178 is also provided with an arcuate groove 194 and the arcuate end portion 196 of the locking or engaging means 172 is slidably mounted in the upper arcuate groove 194 for sliding motion between the position shown in FIG. 3 to the locking position shown, for example, in FIG. 17, when the locking means is in the locking position shown in FIG. 17, it engages a notch 198 on the flange portion 190 of the sleeve member, the notch being best shown in FIG. 16. Thus, when the locking means is in this position, it holds the sleeve member 170 from rotation relative to the first bearing block means 166. The bearing halves 176, 178, when assembled in the manner shown in FIG. 4, hold the sleeve member 170 and the locking means 172 in their assembled position.

The locking or engaging means 172 include a V-shaped wire indicated generally at 200, the wire having upper and lower legs 202, 204, respectively, the arcuate end portion 196 being formed on the end of the leg 204 remote from the intersection of the two legs. A mode selector 206 is pivotally carried by a bent-out end portion 208 of the leg 202, the mode selector being spring biased by the V-shaped wire into one of two spaced apart detents 210, 212 formed on the exterior surface of the first bearing block means 166. When the locking or engaging means is in the position shown in FIG. 3, the intermediate portion 214 of the leg 204 between the intersection of the two legs and the arcuate end portion forms a linearly extending cam track. A cam follower 216 if mounted on the pivot rod 22 and is adapted to engage the longitudinally extending portion 214 for guiding the pivot rod during the dressing of the grinding wheel in a manner which will be more fully brought out below.

The notched flange 190 is supported at one end of a sleeve portion 218 of the rotatable member 170, the inner cylindrical surface of the sleeve portion 218 being provided with spirally disposed teeth 220 which act as a cam or cam follower. The rotatable member 170 also is provided with a handle portion 222 which projects outwardly of the housing 10 to the end opposite from the grinding wheel 14.

A gear 224 having outwardly extending spiral teeth 226 is mounted on the end of the pivot rod 22 which is remote from the holding means 18. The gear with the spiral teeth acts as a cam or cam follower, and cooperates with the spirally disposed internal teeth 220 to impart either longitudinal linear mition to the pivot rod or to impart spiral motion to the pivot rod and the holding means carried by the pivot rod. Thus, when the locking or engaging means 172 is in the position shown in FIG. 3B, if the rotary means 222 are rotated relative to the frame 10, linear motion will be imparted to the pivot rod provided that the cam follower 216 is held in engagement with the cam track 214. When the locking or engaging means 172 is in the position shown in FIGS. 17 and 18, it will interconnect the mounting means 166 with the rotatable means 170 to prevent only lateral shifting motion of the pivot rod, and the teeth 220, 226 on the sleeve portion 218 and gear 224 will guie the twist drill holder for spiral motion about the axis 85, this axis being generally parallel to the surface of the grinding wheel which is engaged during the grinding of the leading end of the twist drills or the like. Thus, the cam and cam follower 220, 226 impart spiral motion to the pivot rod when it is manually rotated about its axis. The end 227 of the pivot rod 22 is D-shaped in cross section, and the gear 224 is provided with a corresponding aperture. A nut 228 is mounted on an extension of the pivot rod and holds the gear in place.

The second bearing block means includes a first bearing portion 229 having a cylindrical aperture for the reception of the pivot rod, the first bearing portion having an external spherical surface 230. The second bearing means also includes a second bearing portion 232 which has an internal spherical surface 234. The second bearing portion further includes two spaced apart slides 236 apart slides 236 which are adapted to slidably engage a plate 238 for vertical motion of the second bearing means, the slide being disposed between one end portion 240 of the housing and a vertically extending lip 242. The second bearing portion 232 is provided with bosses 244 which engage a housing rib 243 and with an apertured portion 245 which is threaded, the apertured portion being parallel to the plate 238 and receiving the means 174 which moves the second bearing block toward and away from the axis of wheel 14. The moving means 174 includes a feed screw 246 which is threadedly received within the apertured portion 245, the upper end of the feed screw passing through an aperture 248 in the housing 10, a manually engagable feed knob 250 being non-rotatably secured to the upper end of the feed screw. A shoulder washer 254 is disposed about the upper end of the feed screw 246 and abuts against a lower surface of the housing adjacent the aperture 248. The feed screw is held from vertical shifting motion by a retaining ring 256 which is received within a groove of the feed screw, the upper surface of the retaining ring 256 bearing against the lower surface of the shoulder washer 254. In addition, the feed knob 250 bears against the upper surface of the housing 10. When the feed knob is rotated, the bearing portion 232 will be caused to be moved upwardly or downwardly with respect to the axis of the grinding wheel 14. Such vertical shifting motion will cause the pivot rod to about the trunions 182, 184.

Clam-shell Housing

Figure 5:
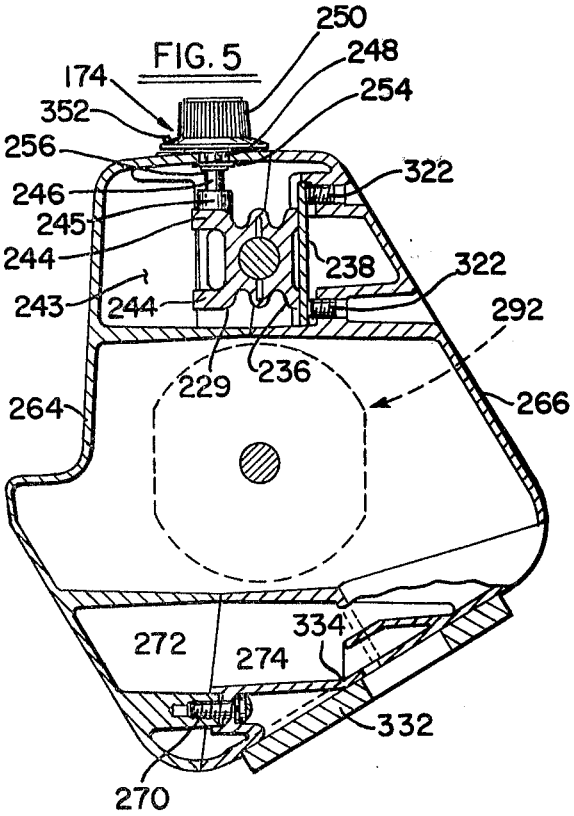
FIG. 5 is a section taken generally along the lines 5—5 in FIG. 3A.

The clam-shell housing is formed of two members having mating edges, as shown in FIGS. 4 and 5, one of the members being referred to as the front housing portion 264 and the other member being referred to as the rear housing portion 266. The front housing portion 264 carries the trunion 182, a trunion being an integral part of the housing. The rear housing portion 266 is provided with a threaded aperture within a recessed portion 268, the threaded aperture receiving the adjustable trunion 268, the threaded aperture receiving the adjustable trunion 184. The front and rear housing portions 264, 266 are secured to each other by fasteners 270, and when so secured with their mating edges 272, 274 in contact with each other, the first bearing block means will be securely mounted for rocking about the trunion 182, 184 when the trunion 184 is properly adjusted. The rear housing portion 266 also carries two adjustable set screws 322 which properly position the plate 238 to ensure proper movement of the second bearing block means 168. The two housing portions 264, 266, are provided with mating cut-out portions 276,.278 through which the upper edge or end of the manually engagable mode selector 206 projects. Notched lugs 280, 282 are carried by each of the housing portions 264, 266, respectively, adjacent the cut-out portion 276, 278 for the purpose of supporting a cover plate 284 which moves with the mode selector 206, the cover plate having indicia (not shown) on its upper surface to indicate whether the apparatus is in its dressing mode or its grinding or sharpening mode. Semi-circular mating cut-outs 286, 288 are provided in the housing portions 264, 266 adjacent the left-hand end to permit the handle portion 222 of the rotatable member 170 to extend outwardly of the housing. Elongated mating apertures 290 (only one of which is clearly shown) are provided in the end portion 240 of the housing, the elongated apertures 290 permitting one end of the pivot rod to extend outwardly of the housing and to be moved upwardly and downwardly with respect to the housing.

Drive means in the form of an electric motor 292 is mounted within a lower chamber of the housing, the lower chamber being formed by two mating partitions 294, 296 (FIG. 4). The motor includes an output or armature shaft 16 which is supported by left and right hand bearings 298, 300, the bearings 298, 300 being in turn supported on the rear housing portion in a manner not material to the present invention. One end of the output shaft 16 projects outwardly of the housing and supports a bushing 302 and an inner clamp washer 302. The outermost end of the shaft 16 is threaded and receives a nut 306 which bears against an outer clamp washer 308 to hold the grinding wheel 14 on the shaft 16. In this connection it should be noted that the bushing 302 and the clamp washer 304 are non-rotatably mounted on the shaft 16.

Figure 1:
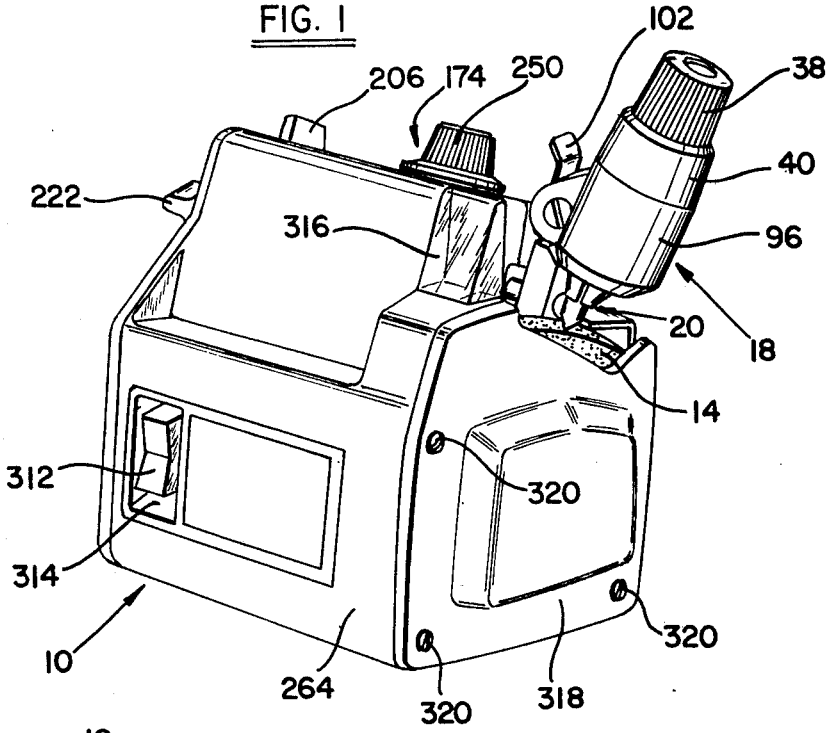
FIG. 1 is a perspective view of an apparatus in which the principles of the present invention are incorporated, this view being taken from the front right side of the apparatus and showing the chuck and its mounting structure in its operative position.

An electrical switch for the motor 292 is mounted within the front housing portion 264, the switch, which is indicated generally at 310 in FIG. 4, having a manually engagable rocker portion 312 which is engagable from outside the portion 264 through an aperture 314 in the front housing portion 264. Eye shield means 316 (FIG. 1) is also carried by the front housing portion 264, the eye shield means being secured to the housing portion in a manner not material to the present invention. A wheel cover 318 is secured to the right hand end of the housing by fasteners 320. A line cord 324 extends outwardly of the housing and is in turn interconnected with the switch for the electric motor for powering the electric motor. The rear housing portion 266 is provided with a recess 326, there being a spring clip 328 mounted within the recess for the purpose of holding the dressing tool 330. The housing is adapted to be supported on the top of a bench or the like, the housing carrying a pad 332 which is disposed between the base 334 of the housing and the bench top.

Operation

Figure 24:
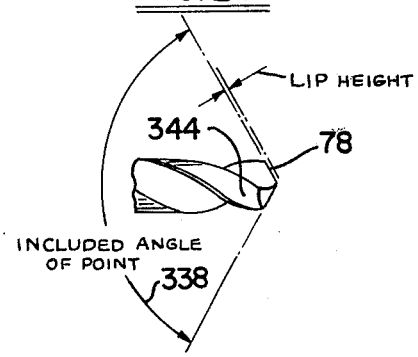
FIG. 24, 25 and 26 are front side, top side, and end views, respectively, of a twist drill.
Figure 25:
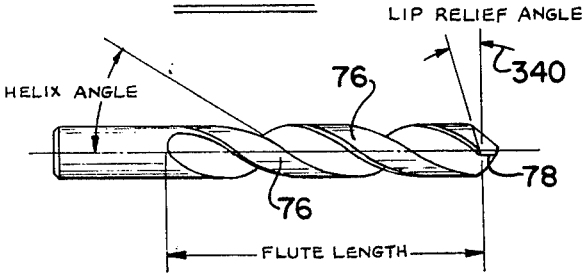
Figure 26:
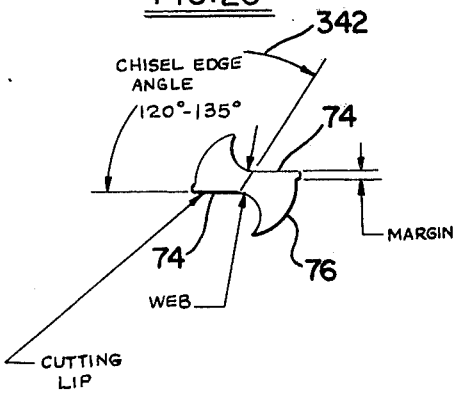

The present apparatus is so designed that it will grind to commercial tolerances a cylindrical profile on the leading end of twist drills or the like having diameters from approximately ⅛ inch to approximately ½ inch. Thus, in accordance with commercial tolerances, there must not be a difference in lip height of more than three thousandths of an inch in drills up to one-quarter of an inch in diameter or more than four thousandths of an inch of drills from ¼ to ½ inch in diameter, the difference in lip height being schematically illustrated at 336 in FIG. 24. The point angle 338 should be preferably midway within the range of 113° to 123°. The lip relief angle 340 (FIG. 25) should vary from approximately 8° to 10° for a ½ inch diameter twist drill to approximately 15° for a ⅛ inch diameter twist drill. The chisel edge angle 342 (FIG. 26) should be within the range of 120° to 135°. In addition, the heel of the flute 344 (FIG. 24) must be below the cutting edge. In practice, it has been found that if the relief angle and point angle are within commerical tolerances that then the chisel angle will also be within the commercial tolerances that then the chisel angle will also be within the commercial tolerances.

Figure 17:
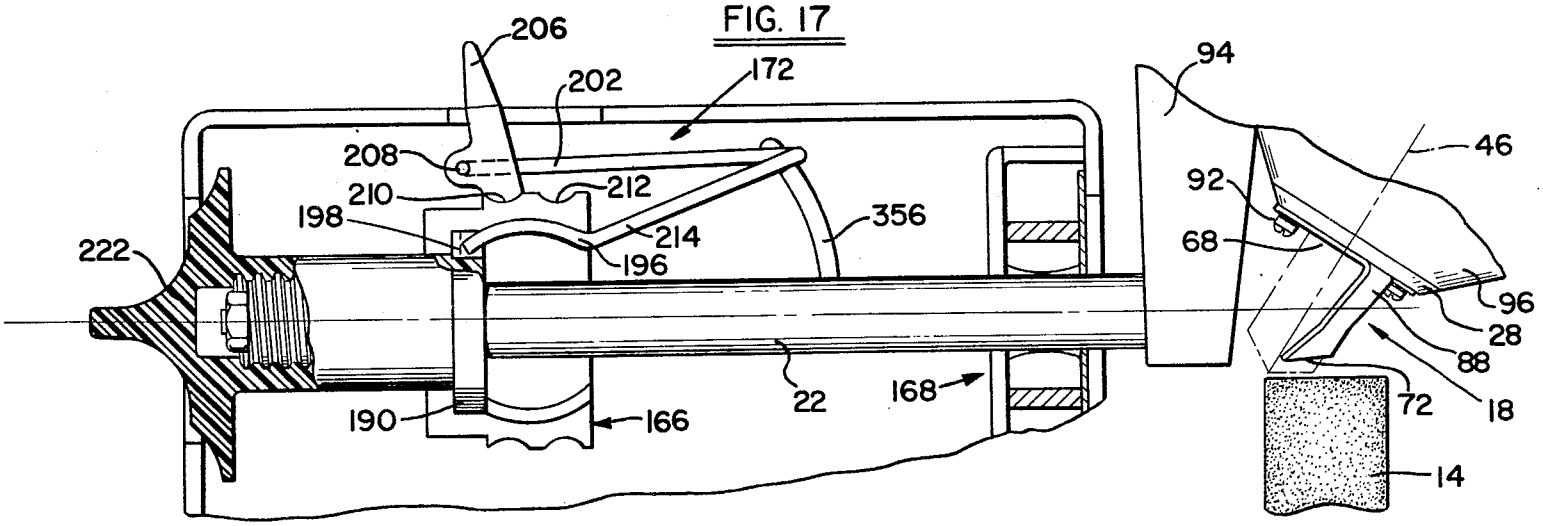
Figure 18:
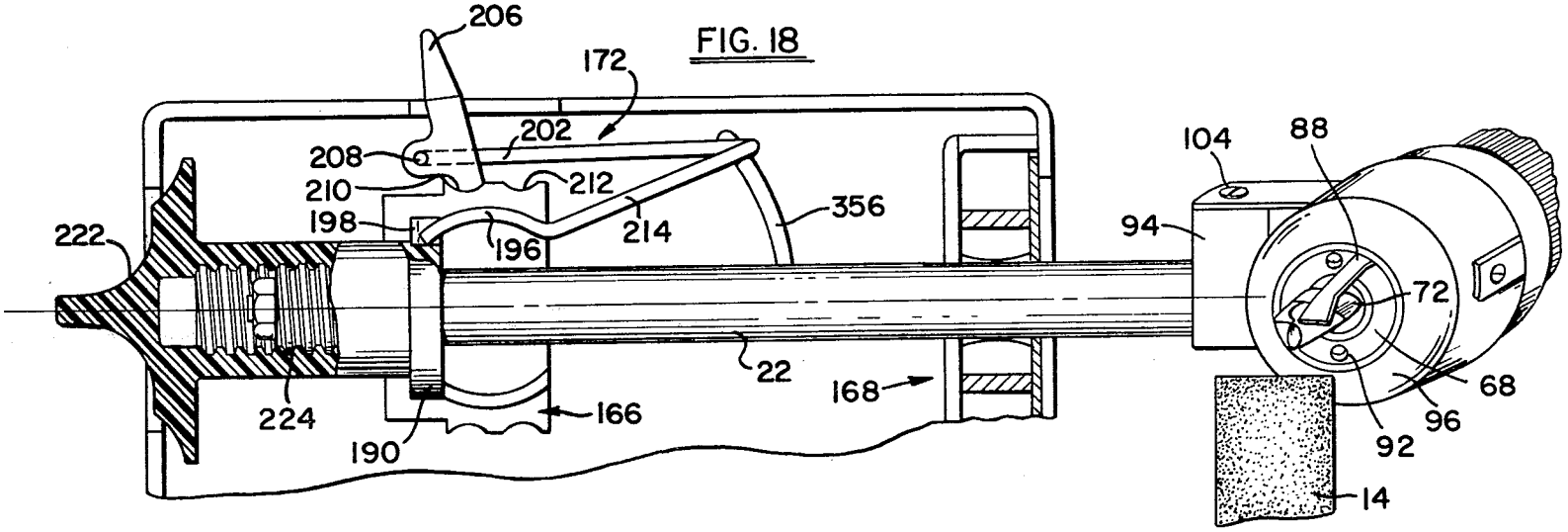
Figure 19:
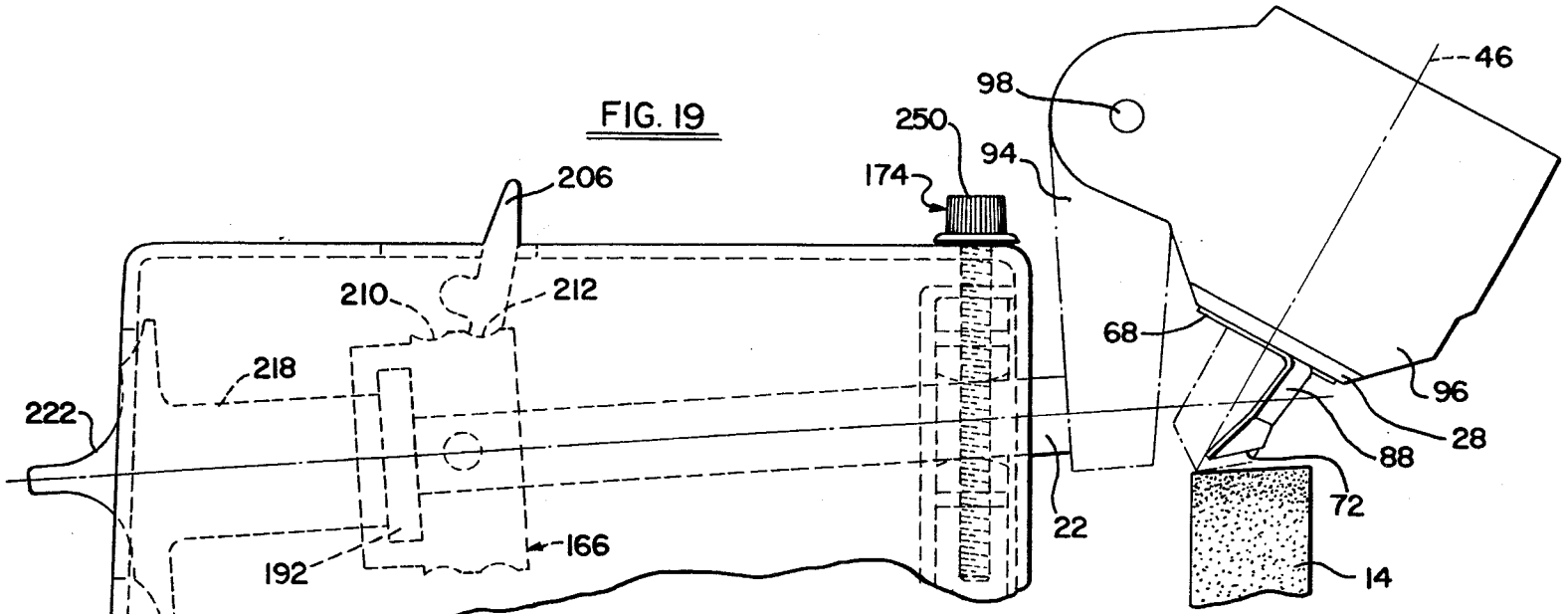
FIGS. 19 and 20 are somewhat exaggerated views showing the manner in which the pivot rod is pivoted between its raised and lowered positions.
Figure 20:
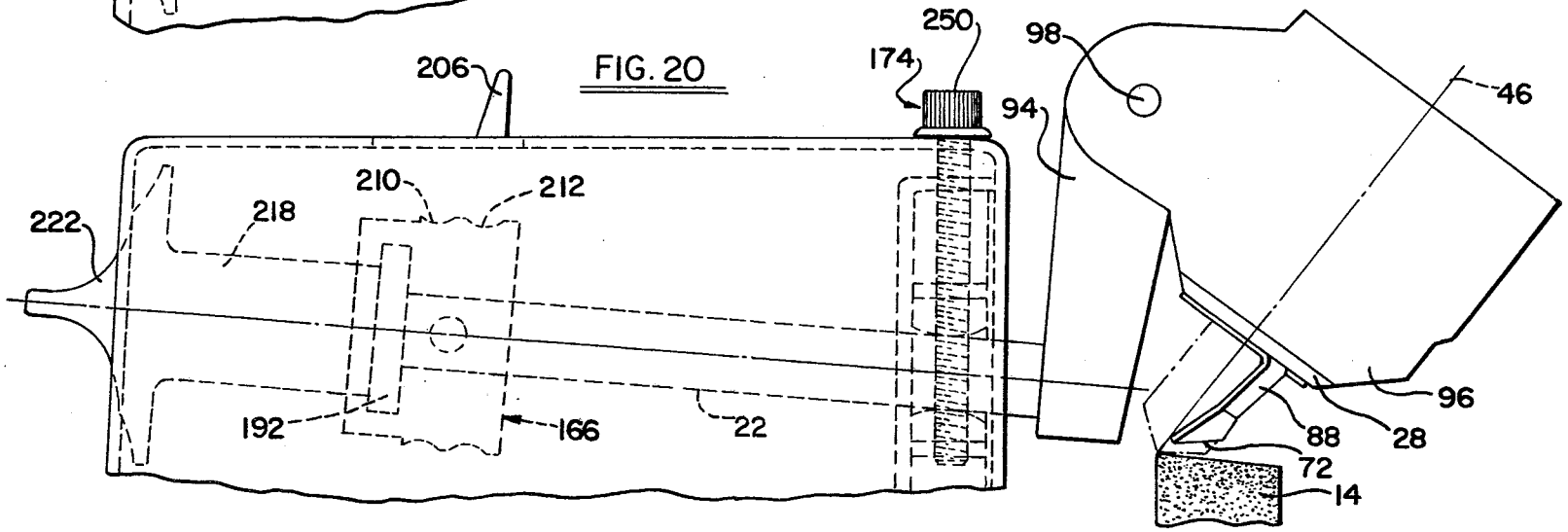

To sharpen a twist drill or the like, it is necessary to initially place the mode selector 206 in the positon illustrated in FIGS. 17 and 18. When the mode selector is in this position, the end of the arcuate end portion 196 will engage the notch 198 of the flange portion 190 to thereby hold the rotatable sleeve member from rotation with respect to the first bearing block means 166. The mode selector will be held in this position by the spring action of the V-shaped wire which biases one end of the mode selector 206 into the detent 210. The holding means 18 is then swung to the loading position illustrated in FIGS. 2 and 7 and this is accomplished by biasing the latch or jam spring 102 in the direction indicated by the arrow 130 and then swinging the holding means in the direction indicated by the arrow 346 in FIG. 3.

Figure 2:
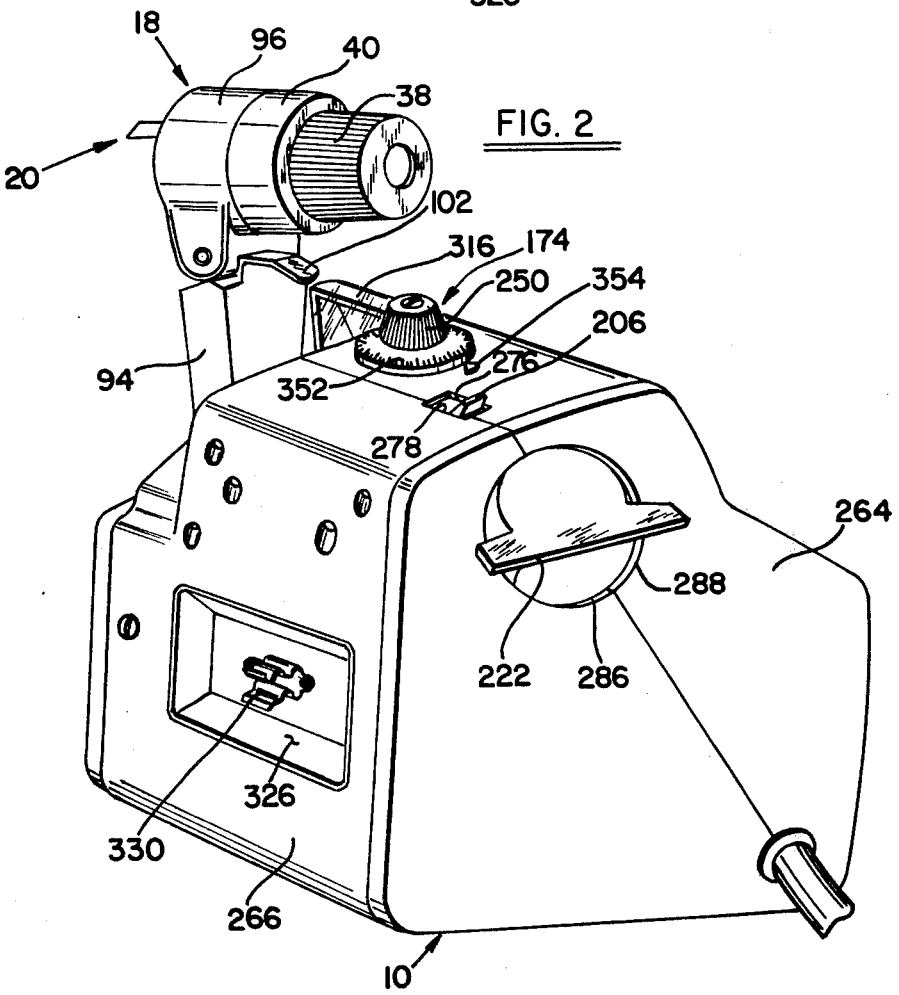
FIG. 2 is a perspective view taken from the left rear side of the apparatus, the chuck being shown in its inoperative position.
Figure 12:
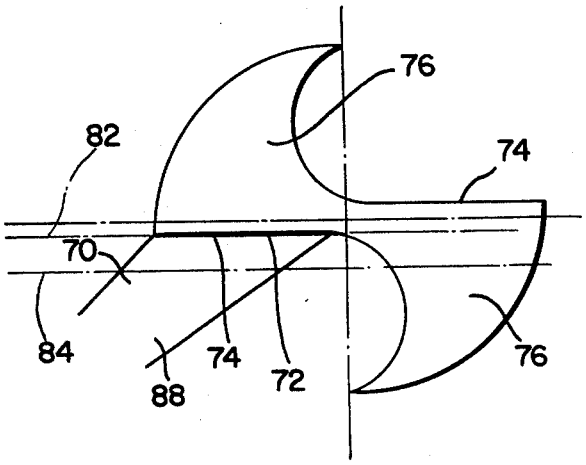
FIGS. 12 and 13 show the manner of locating twist drills with the locator of the present invention.
Figure 13:
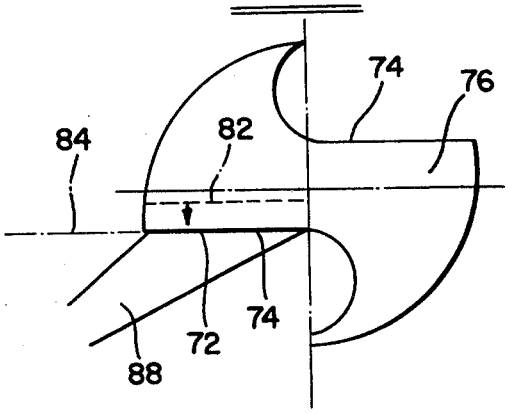

After the holding means 18 has been placed in the position shown in FIGS. 2 and 7, the chuck is opened by turning the nut 38 in a counter-clockwise direction. The twist drill is then inserted within the chuck and it should be noted that it can be inserted at either end of the chuck. The leading end of the bit is positioned by locating it in such a manner that it protrudes approximately one-sixteenth of an inch past the edge 72 of the locator. If the bit is badly worn or chipped, it may be desirable to initially rough out the point on another grinding wheel or alternatively, the point could extend a further distance away from the edge of the locator. It is necessary that the edge 72 be in full contact with the side wall of the bit as shown in FIGS. 12 and 13 in order to properly position the bit within the apparatus. After the bit has been properly located the chuck is tightened by rotating the nut 38 in a clockwise direction. The chuck should be placed in one of its two detent positions and a click will be felt when rotating the chuck to its detent position. If the feed means 174 was not backed up after the previous sharpening, the feed knob 250 should be turned counter-clockwise three or four turns. The swing head should then be lowered to the position shown in FIGS. 1 or 3A until the jam spring moves into the position shown in FIG 3A.

If the motor is not on at this point, it should be turned on. The motor will rotate the grinding wheel so that the surface 348 of the wheel 14 which contacts the leading end of the bit will move in a direction away from the eye shield 316 to reduce the likelihood of any swarf from entering the environment of the operator. The operator of the apparatus will now engage the holding means 18 with his right hand swing the chuck toward and away from him. As the rotatable sleeve member 170 is held from rotation in this mode of operation the interengagement of the spiral splines or teeth on the gear and the inner surface of the sleeve member will cause the holding means to move in a spiral manner to progressively move the leading end of the bit across the surface of the grinding wheel. This feature can best be seen from a comparison of FIGS. 17 and 18 wherein FIG. 17 shows the holding means in its initial position and FIG. 18 shows the holding means after it has been swung by the operator. If the bit does not initially engage the grinding wheel, the feed knob 250 should be adjusted by rotating it in a clockwise direction to feed the bit to the grinding wheel. This is accomplished because when the feed knob is rotated the pivot rod will be caused to be rotated about the axis 27. The surface 348 of the grinding wheel is generally parallel to the axis 85 of the pivot rod and this is accomplished by dressing the grinding wheel by using the holder in a manner which will be more fully brought out below. The tool holder or chuck is so positioned that the axis 46 of the bit is eccentric to the axis 85 of the pivot rod, this being indicated at 86 in FIGS. 14 and 15. This will ensure that the relief angle of the bit when properly located and ground is within commercial tolerances.

After the surface of one of the flutes 76 (FIG. 25) has been initially ground, different modes of operation may be utilized. According to one mode of operation, after the leading end of one of the flutes has been ground by swinging the holder toward and away from the operator, feed knob 250 is rotated in a clockwise direction a small amount, and the twist drill is again moved toward and away from the operator to repeat the grinding, and these steps are continued until the cutting lip 78 of the bit is within two to three hundredths of an inch from the locator edge 72. At this point the distance which the leading end of the twist drill or the like is spaced away from the surface 348 of the grinding wheel would be noted. This is easily accomplished by providing indicia 352 (FIG. 5) on the feed knob 250 which is lined up with a corresponding indicia 354 on the top of the housing. The swing head will now be swung away from the operator until it stops. The chuck will now be indexed 180° until the semi-cylindrical recesses 66 engage the other V-shaped portions 158, 162 of the detent spring 100. The feed knob 250 will be rotated in a counter-clockwise direction to move the chuck away from the axis and outer surface of the grinding wheel, and then the holding means will be swung towards and away from the operator a number of times while the operator progressively turns the feed knob 250 in clockwise direction until the leading end of the twist is spaced away from the surface of the grinding wheel the noted distance. In order to put a finish grind on the flutes the feed knob is turned once more in accordance with the indicia on the feed wheel to move the leading end a slight distance toward the surface of the grinding wheel at which point the holding means is moved toward and away from the operator again to put a finished surface on the leading edge of one of the flutes, the chuck is then rotated 180° without further movement of the feed knob, and the leading end of the other flute is then finish ground. To remove the drill after grinding, it is only necessary to swing the holding means from the position shown in FIG. 3A to the position shown in FIG. 2, turn the nut 38 in the appropriate direction, and remove the twist drill or the like.

According to another grinding grinding mode, the twist drill can be ground by indexing the chuck after the first pass has been made to present the leading end of the other flute to the grinding wheel, by swinging the holding means towards and away from the operator, by turning the feed knob a slight amount to advance the bit towards the grinding wheel, then successively repeating the grinding, indexing, grinding, and advancing steps until a satisfactory surface has been ground on the leading end of the twist drill or the like.

When a satisfactory surface has been ground on the leading end, the leading end or edge 72 of the locator 20 will be spaced a predetermined distance away from the surface of the grinding wheel.

By moving the holding means in a spiral manner the surface of the grinding wheel will be more uniformly worn than if the holding means were to simply rotate about a fixed axis. However, it will still be necessary to dress the wheel. To dress the wheel, it is necessary to mount the dressing tool 330 within the chuck and this is done in substantially the same manner in which a twist drill is positioned within the chuck. The leading end of the dressing tool will project a slight distance beyond the end of the locator in the manner shown in FIGS. 3 and 16. Before the wheel can be dressed, the mode selector 206 must be disposed in the position shown in FIG. 3B or 16. However, before the mode selector is placed in this position, the tool holder is swung toward the operator in order to position the cam follower 216 to the proper side of the longitudinal wire 204. Once the mode selector has been placed in the desired position, the end of the arcuate section 196 will no longer engage the flange 198 and, therefore, the rotatable member 170 will be free to rotate within the bearing block 166. The chuck is now rotated away from the operator until the cam follower 214 engages the cam track 204. When in this position the wire member 200 is stabilized by a rib 356 carried by the rear section 266 of the housing. The operator will now maintain slight pressure on the holding means with his right hand to hold the cam follower 216 against the cam track 204 and will rotate the dressing knob with his left hand to cause the diamond dresser to traverse the wheel. The dressing tool should be initially positioned midway between the sides of the wheel and fed in until the leading end of the dressing tool just touches the wheel. The handle 222 is now rotated in one direction to move the diamond dresser off the wheel, the dresser and pivot rod moving in a longitudinal linear manner. The feed knob 250 is then turned a slight increment and the handle 222 is rotated in an opposite direction to again dress the wheel. The operation is continued until the surface of the grinding wheel is smooth. As the pivot rod moves along its axis 85 during the dressing of the wheel, the surface 348 of the grinding will always be generally parallel to the axis 85 of the pivot rod. At the completion of the dressing operation, the feed knob is backed off at least one turn and the holding means is raised to the position shown in FIG. 2 and the diamond dresser is removed.

From the foregoing description and figures, it will be apparent that the present invention concerns a mechanism for sharpening twist drill bits which embodies numerous advantages and improvements over the prior art. Of particular significance is the overall combination whereby very accurate sharpening is easily accomplished with a simplified, compact and low-cost mechanism. These advantages are attributable to many of the aspects of structure as set forth above. Of particular importance, however, is the arrangement of the pivot rod and its mounting system whereby the twist drills are juxtaposed with the grinding wheel and moved through the spiral path which produces the desired cutting edge configuration. The complex motions for which the pivot rod is mounted are of basic importance in this regard.

It is also noted that many other aspects of this construction cannot be overlooked. For example, the self-adjusting location means and the holding means which permits indexing of the twist drills without disturbing the relationship thereof to the grinding surface are important features which also contribute significantly to the quality of results obtained from this overall system. Another important feature is the arrangement for dressing the wheel with exactly the same elements used for the sharpening operation, thus guaranteeing appropriate alignment of the grinding wheel surface.

It is further noted that, while the overall arrangement including all of the described constructional features represents the best and preferred embodiment, many of these individual features could advantageously be used in simplified and somewhat less effective, but nonetheless useful products. Accordingly, it is intended that the appended claims encompass not only the total sharpening system as described hereinbefore. but also all such changes, modifications and subcombinations of the various features as will be apparent to those skilled in this art.

What is claimed is:

1. A method of dressing the grinding wheel in an apparatus used for grinding the leading ends of twist drills or the like, said apparatus including a grinding wheel mounted in the apparatus and holding means mounted on a pivot rod and operable to hold the leading end of twist drills or the like in engagement with the grinding surface of the grinding wheel for movement across and parallel to said surface along a direction line defined by the pivot rod, the holding means and pivot rod being rotatable about an axis transverse to the axis of rotation of the grinding wheel for adjusting the position of the holding means to the gradual wear sustained by the grinding wheel, said method comprising the following steps:

A. rotating the grinding wheel about its axis of rotation;

B. positioning a dressing tool in said holding means;

C. linearly moving the holding means along said direction line to move the dressing tool back and forth laterally across said surface;

D. rotating said holding means and pivot rod about said axis transverse to the axis of rotation of the grinding wheel to ensure engagement of the dressing tool with said surface; and, E. repeating steps (C) and (D) a number of times thereby causing said grinding surface to be dressed so as to be parallel to said direction line irrespective of the wear sustained by said grinding wheel.

* * * * *

UNITED STATES PATENT OFFICE
CERTIFICATE OF CORRECTION

Patent No. 4,023,552 Dated May 17, 1977

Inventor(s) Robert Gordon Moores, Jr., Richard Eugene Walton, II

It is certified that error appears in the above-identified patent and that said Letters Patent are hereby corrected as shown below:

Column 6, line 61, "grining" should read --grinding--.

Column 7, line 25, "the" should read --a--.

Column 8, line 50, "of" first occurrence should read --for--.

Column 8, line 58, after "the" first occurrence insert --outer--.

Column 9, line 29, after "of" insert --its--.

Column 9, line 42, "mens" should read --means--.

Column 10, line 58, "mition" should read --motion--.

Column 11, line 3, "guie" should read --guide--.

Column 11, line 21, delete "apart slides 236" second occurrence.

Column 11, line 49, after "to" insert --rock--.

UNITED STATES PATENT OFFICE

CERTIFICATE OF CORRECTION

Patent No. 4,023,552 Dated May 17, 1977

Inventor(s) Robert Gordon Moores, Jr., Richard Eugene Walton, II

It is certified that error appears in the above-identified patent and that said Letters Patent are hereby corrected as shown below:

Column 12, line 3, after "proper" insert --vertical--.

Column 12, line 34, the numeral "302" second occurrence should be --304--.

Column 13, line 16, after "ances" insert a period --.--.

Column 13, lines 16 and 17, delete "that then the chisel angle will also be within the commercial tolerances."

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*